United States Patent [19]

Baker

[11] Patent Number: 4,667,604

[45] Date of Patent: May 26, 1987

[54] AUTORACK RAILROAD CAR IMPROVED BRIDGE PLATE SUPPORT STRUCTURE

[75] Inventor: William R. Baker, Lawrenceville, Ga.

[73] Assignee: Thrall Car Manufacturing Company, Chicago Heights, Ill.

[21] Appl. No.: 763,677

[22] Filed: Aug. 8, 1985

[51] Int. Cl.[4] ..... B61D 3/18

[52] U.S. Cl. ..... 105/378; 105/458

[58] Field of Search ..... 14/69.5, 71.1; 104/275, 104/277; 105/436, 458, 459, 378

[56] References Cited

U.S. PATENT DOCUMENTS

| | | | |
|---|---|---|---|
| 66,419 | 7/1867 | Traxler | 105/458 |
| 3,228,355 | 1/1966 | Black | 105/458 |
| 3,351,024 | 11/1967 | Broling | 105/458 |
| 3,370,552 | 2/1968 | Podesta et al. | 105/458 X |
| 4,437,410 | 3/1984 | Stoller, Sr. et al. | 105/378 |

*Primary Examiner*—Robert B. Reeves
*Assistant Examiner*—David F. Hubbuch
*Attorney, Agent, or Firm*—Marshall, O'Toole, Gerstein, Murray, and Bicknell

[57] ABSTRACT

A railroad car for transporting vehicles such as automobiles and trucks, comprising a floor and two side walls defining an interior space and terminating in an opening at each end; at least one elevated deck spaced above the floor and extending the length of the railroad car and terminating in an end at each of the openings; an end enclosure at each end of the car adapted to be displaced between a closed position overlying the end opening and an opened position which provides access to the entire end of the car; an elongated closure support member at each end of the car disposed within the car interior in a horizontal plane and joined to the end of the deck with the deck elevation being at least as high as that of the closure support; and bridge plate supports, for a pair of bridge plates, located at the front of the closure support member such that bridge plates removably attached thereto are at essentially the same level as the deck.

3 Claims, 9 Drawing Figures

FIG. 8
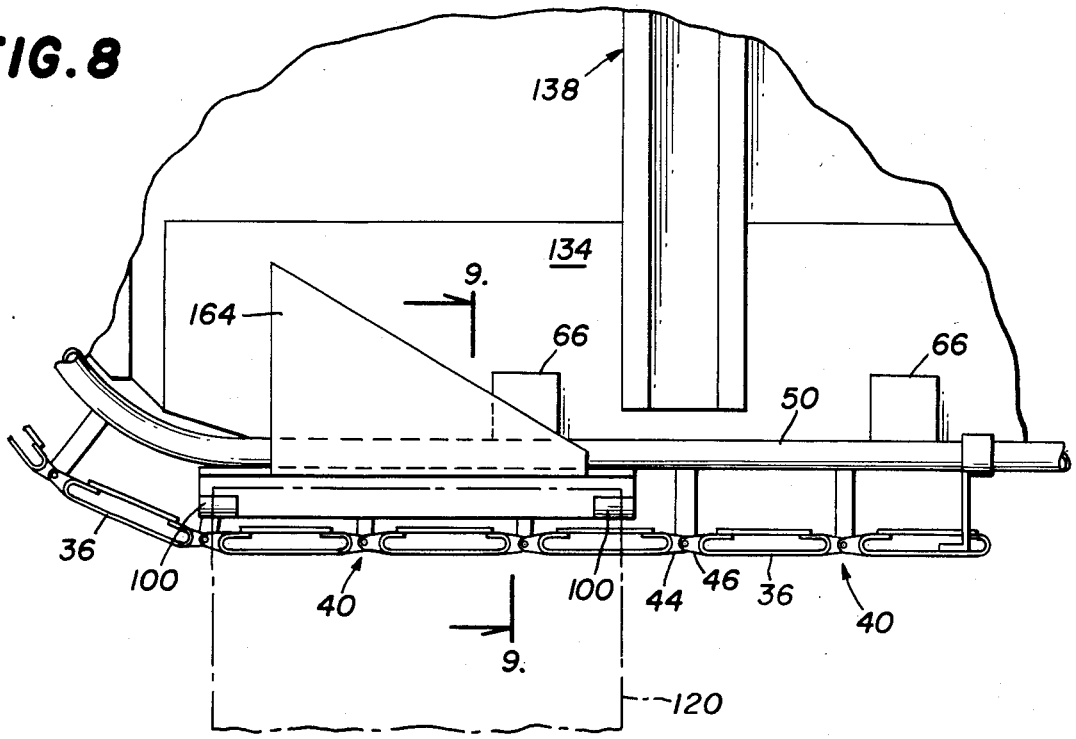
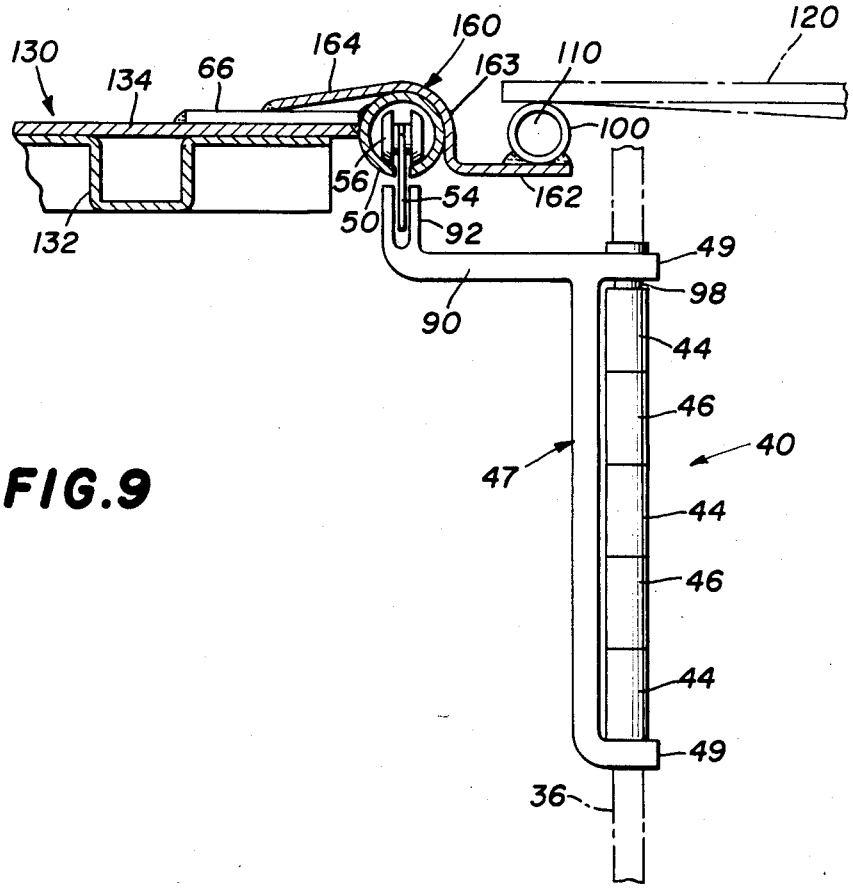
FIG. 9

AUTORACK RAILROAD CAR IMPROVED BRIDGE PLATE SUPPORT STRUCTURE

This invention relates to railroad cars used to transport vehicles such as automobiles and trucks, and which are generally referred to as auto rack cars. More particularly, this invention is concerned with an improved bridge plate support to facilitate unloading vehicles from such cars.

BACKGROUND OF THE INVENTION

Railroad cars are widely used in the United States and other countries to transport vehicles such as automobiles and trucks from manufacturing plants to distribution centers. Such railroad cars are referred to in the trade as auto rack cars.

The railroad cars include a floor and a pair of side walls which support at least one, and usually two, elevated decks. Additionally, a roof is generally included to protect the vehicles against damage. The floor and each deck carry lined-up vehicles.

It is customary to load, and for railroads to move, a number of such cars in groups hitched together end-to-end and, after arrival at a distribution center, for the group of cars to be unloaded simultaneously. When a group of cars is loaded simultaneously, they enter at one end and are driven forward as far as possible to a tie down position on one of the cars. This is called circus loading. To make such loading possible the distance between adjoining car ends must be spanned by removable bridge plates at the car floor level and at each deck level. The bridge plates support the vehicle wheels as the vehicles roll from one railroad car to the next.

Vehicles are unloaded from the group of railroad cars in a similar manner, referred to as circus unloading. Vehicles are driven forward from one car to the next over bridge plates and ultimately down ramps, at the forward end of the front car, to the ground.

Stoller et al U.S. Pat. No. 4,437,410 discloses an auto rack railroad car with a closure at each end to prevent vandalism and thievery. Each closure comprises two door assemblies which move horizontally to open and close the car end. The door assemblies are movably supported by a horizontal support member mounted on the front end or edge of the uppermost of two elevated decks. Mounted on the top of both decks, adjacent the front end, is a bridge plate attaching means which constitutes a ridge over which vehicles must be driven in loading and unloading the cars. Because there is very little clearance between the vehicle roof tops and the railroad car roof top or a deck, the ridge causes vehicles to bump and spring higher. This causes the vehicle roofs to hit the railroad car roof or deck and damage the automobile with significant economic loss. There is thus a need for alternative structural arrangements which permit removable attachment of bridge plates to railroad cars with elimination of the present described bump-inducing ridges.

SUMMARY OF THE INVENTION

According to the invention, a railroad car for transporting vehicles such as automobiles and trucks is provided comprising a floor and two side walls defining an interior space and terminating in an opening at each end; at least one elevated deck spaced above the floor and extending the length of the railroad car and terminating in an end at each of said openings; an end enclosure at each end of the car adapted to be displaced between a closed position overlying the end opening and an opened position which provides access to the entire end of the car; an elongated closure support member at each end of the car disposed within the car interior in a horizontal plane and joined to the end of the deck with the deck elevation being at least as high as that of the closure support; and bridge plate supports, for a pair of bridge plates, located at the front of the closure support member such that bridge plates removably attached thereto are at essentially the same level as the deck.

The closure can comprise a pair of door assemblies movable horizontally toward each other into closed position and away from each other into open position; and the door assemblies can be suspended from the closure support member by brackets which position the door assemblies outwardly beyond the bridge plate supports.

Each bridge plate support can comprise a plate joined to the deck and the closure support member which extends downward in front of the closure support member and then outward as a horizontal support flange. A pair of spaced apart horizontal stub tubes can be joined to the flange and adapted to receive retaining pins from a bridge plate.

BRIEF DESCRIPTIONS OF THE DRAWINGS

FIG. 8 is a plan view of a second embodiment of bridge plate support according to the invention; and FIG. 9 is a sectional view taken along the line 9—9 of FIG. 8.

DETAILED DESCRIPTION OF THE DRAWINGS

To the extent it is reasonable and practical, the same or similar elements in the various views of the drawings will be identified by the same numbers.

Figure 1:
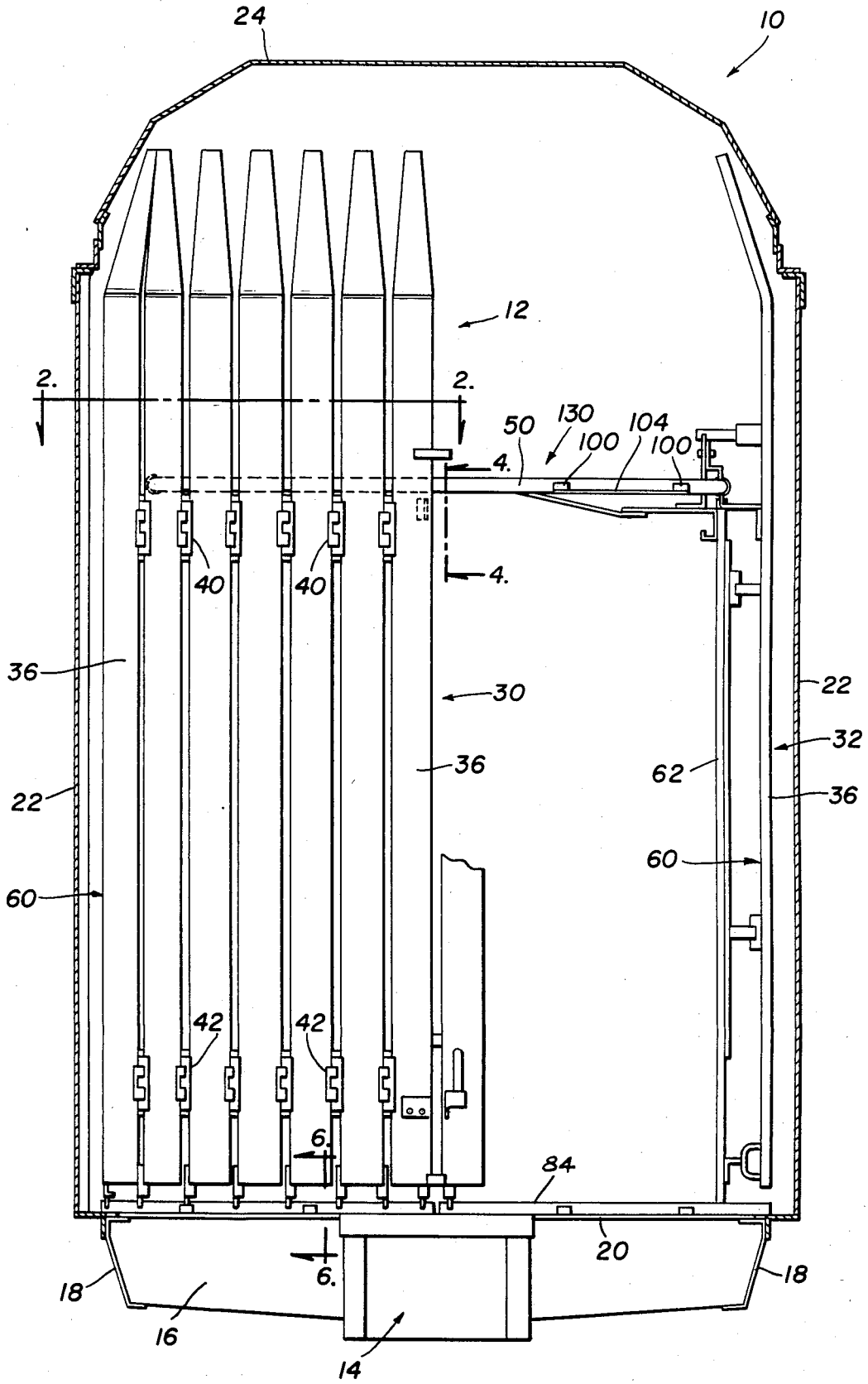
FIG. 1 is an end elevation, partially in section, of a rail car with an end enclosure comprising two door assemblies with one in the closed position and one in the opened or stowed position.

With reference to FIG. 1, the railroad car 10 has an end closure 12, at each end of the car, which is adapted to seal off the car when it is loaded with automobiles or trucks to prevent vandalism and pilferage.

Center sill 14 extends the length of the car body and supports lateral spaced apart floor cross bearers 16 to which side sills 18 are connected. Floor 20 is mounted on the top of the center sill, side sills and floor cross bearers. Side walls 22 extend up from side sills 18 and support roof 24.

Car end closure 12 comprises a pair of door assemblies 30,32 which are essentially mirror images of each other. Door assembly 30 is shown in the closed position while door assembly 32 is shown in the open or stowed position. When in the stowed position, each door assembly is positioned entirely within the car along a car side wall 22. Each door assembly 30,32 includes panels 36 which are essentially identical. The panels 36 can be made of metal or reinforced polymeric material.

Figures 2, 3:
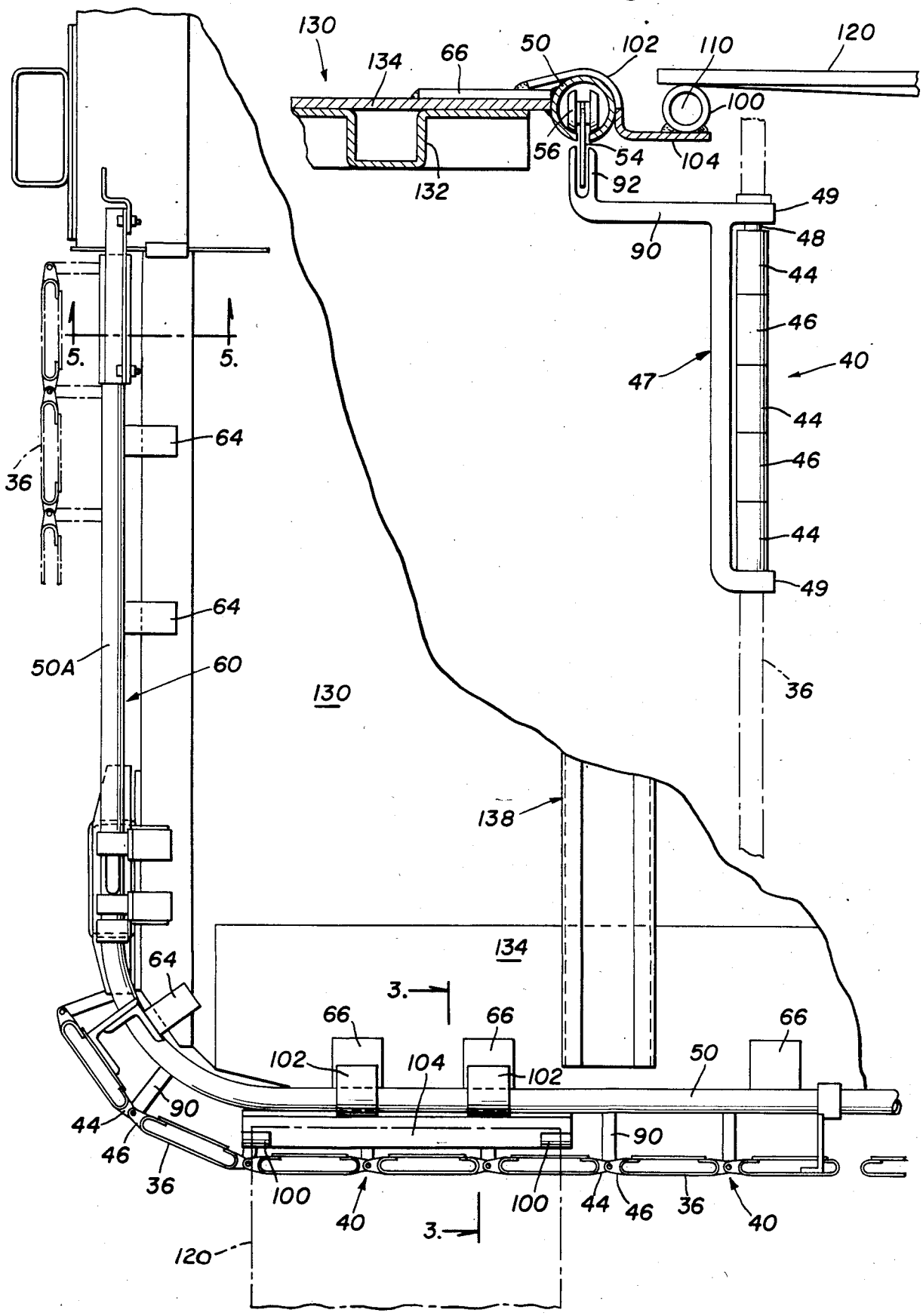
FIG. 2 is a horizontal sectional view taken along the line 2—2 of FIG. 1 and illustrates one embodiment of bridge plate support according to the invention.
FIG. 3 is a vertical sectional view taken along the line 3—3 of FIG. 2.
Figure 4:
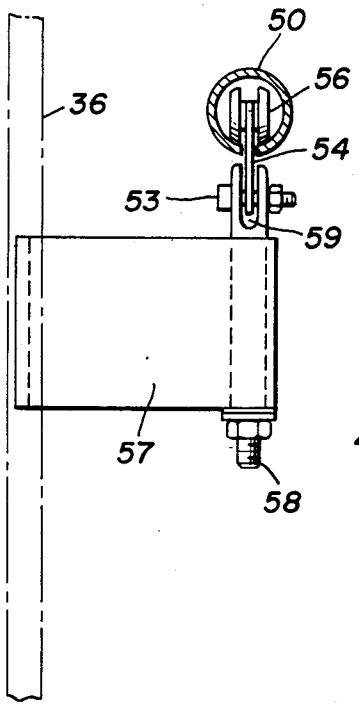
FIG. 4 is a vertical sectional view taken along the line 4—4 of FIG. 1.

Adjoining panels 36 are pivotally joined to one another at two or more vertically spaced apart locations, such as by upper hinge assemblies 40 and lower hinge assemblies 42. Each upper hinge assembly 40 includes a hinge element 44, carried by one lateral edge of each panel 36, and which cooperates with a hinge element 46 carried by an edge of an adjacent panel 36. The elements 44,46 are hinged together by a pin 48 (FIG. 3). The lower hinge assemblies 42 are similarly made and attached to the panels 36. The end panels of each door assembly do not require a hinge support extending to member 50. Instead, plate 57 is joined to a panel edge and extended inwardly to support an adjustable bolt 58 which has a slot 59 at the top to receive an arm 54 secured thereto by bolt 53 (FIG. 4).

Each door assembly 30,32 is suspended vertically by means of a support member or track 50 comprising an elongated track element disposed horizontally along the front edge or end of elevated deck 130. Deck 130 is fabricated from corrugated metal sheets 132. The corrugations are positioned to run lateral to the railroad car. A lateral plate 134 is placed on the top of the corrugated sheets 132 at the end of the deck. A pair of tie down channels 138 are used to secure vehicles in place.

Figure 5:
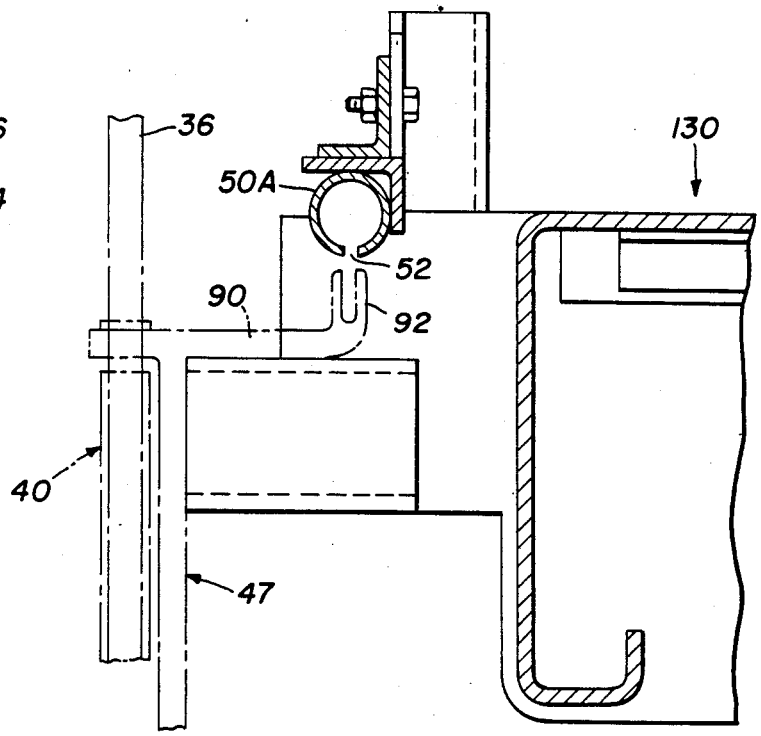
FIG. 5 is a vertical sectional view taken along the line 5—5 of FIG. 2.
Figure 6:
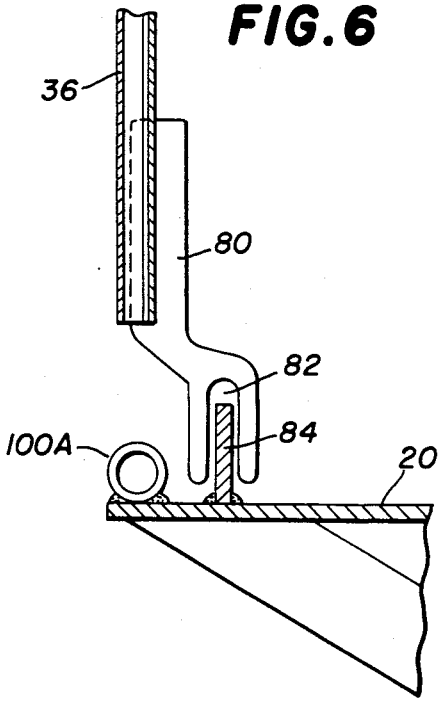
FIG. 6 is a vertical sectional view taken along the line 6—6 of FIG. 1.
Figure 7:
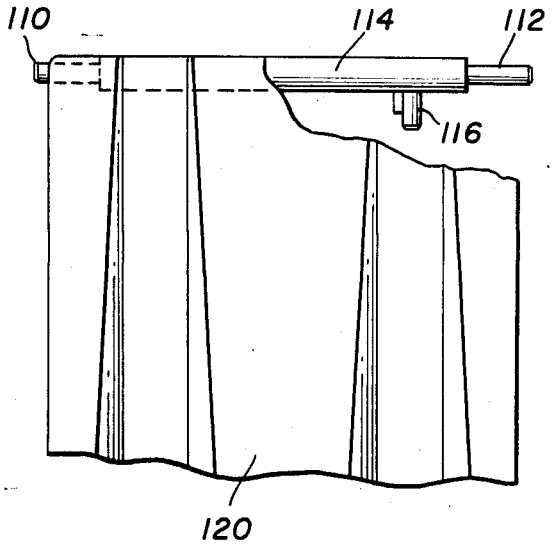
FIG. 7 is a plan view, broken away, of the attaching end of a bridge plate.

Support member 50 is substantially circular in section with a longitudinal slot 52 in the bottom (FIG. 5) to slidably receive arm 54 joined to rollers 56 in member 50.

Support member 50, in plan view, is U-shaped and the legs 50A of the U are disposed within spaces 60 located between the car side walls 22 and deck vertical support plates 62 extending from the car floor 20 to the deck 130. Brackets 64 connect the support legs 50A to the deck 130. The front portion of support member 50 is connected to the end of deck 130 by brackets 66 (FIGS. 2 and 3).

The lower portion of each door assembly is slidably guided by members 80 attached to the lower inner sides of panels 36. Each member 80 has a vertical groove 82 in its lower end which straddles a guide rail 84 mounted on car floor 20. Guide rail 84 follows a horizontal path parallel to the path of support member 50.

The door assemblies 30,32 are suspended from support member 50 by a plurality of hanger assemblies 47 which are desirably integrated in part with the upper hinge 40. Thus, each hanger assembly 47 has top and bottom lateral ends 49 through which hinge pin 48 extends (FIG. 3). The top of each hanger assembly 47 is provided with an elongated horizontal extension member 90 which contains a vertical upwardly projecting flange 92. The lower end of arm 54 fits into slot 94 in flange 92 and is connected thereto by a pin. The extension member 90 spaces door panels 36 sufficiently far forward from support member 50 to provide room at the front end of deck 130 for the bridge plate support stub tubes 100 (FIGS. 1 to 3) to be mounted forward of support member 50 and horizontal therewith.

As shown in FIG. 3, a pair of spaced apart tab plates 102 extend over support member 50 and are joined to it and bracket 66 by welding. Horizontal outwardly extending longitudinal plate 104 is joined at its inner edge to tab plates 102. The stub tubes 100 are mounted on top of plate 104 near its ends. They are placed far enough apart to removably receive pins 110 and 112 of bridge plate 120. The pin 110 is fixedly secured to the bridge plate while the pin 112 is spring loaded but is retractable in tube 114 by handle 116. Tube 114 is joined to the bottom of one end of the bridge plate. In a similar manner, stub tubes 100A are mounted on the end of floor 20 to removably support a bridge plate.

It is to be understood that the ends of deck 130 have two pair of bridge plate support stub tubes 100 which are so positioned to support a pair of bridge plates 120 spaced apart so as to be centered with respect to the average tread width of vehicles transported by the railroad car.

A second embodiment of bridge plate support is illustrated by FIGS. 8 and 9. In this embodiment, the bridge plate support 160 constitutes a single formed plate having a forward horizontal portion which supports stub tubes 100, a curved intermediate portion 163 which mates with the upper portion of support 50, and a rear portion 164 which slopes slightly downward to the rear. Rear portion 164 is triangular shaped as shown in FIG. 8. The plate 134 curves downward at its outer ends so the increased length of the triangular portion makes it possible for the bridge support 160 to extend to that plate and to be welded to it for a length adequate to provide needed strength.

The foregoing detailed description has been given for clearness of understanding only, and no unnecessary limitations should be understood therefrom, as modifications will be obvious to those skilled in the art.

What is claimed is:

1. A railroad car for transporting vehicles such as automobiles and trucks, comprising:

a floor and two side walls defining an interior space and terminating in an opening at each end;

at least one elevated deck spaced above the floor and extending the length of the railroad car and terminating in an end at each of said openings;

an end closure at each end of the car adapted to be displaced between a closed position overlying the end opening and an opened position which provides access to the entire end of the car;

the closure comprising a pair of door assemblies movable horizontally toward each other into closed position and away from each other into open position;

an elongated closure support member at each end of the car disposed within the car interior in a horizontal plane and joined to the end of the deck with the deck elevation being at least as high as that of the closure support member;

bridge plate supports, for a pair of bridge plates, located at the front of the closure support member such that bridge plates removably attached thereto are at essentially the same level as the deck;

the bridge plate supports being between the closure support member and the door assemblies; and the door assemblies being suspended from the closure support member by brackets which position the door assemblies outwardly beyond the bridge plate supports.

2. A railroad car according to claim 1 in which each bridge plate support comprises a plate which is joined to the deck and the closure support member and extends downward in front of the closure support member and then outward as a horizontal support flange; and a pair of spaced apart horizontal stub tubes joined to the flange and adapted to removably receive retaining pins from a bridge plate.

3. A railroad car according to claim 2 in which the bridge plate support includes a portion which curves over the top of the closure support member and extends into contact with the deck and is joined thereto.

* * * * *